United States Patent [19]

Preussner

[11] Patent Number: 4,549,394

[45] Date of Patent: Oct. 29, 1985

[54] STRANDING DEVICE FOR STRANDING MACHINES, PARTICULARLY A PRE-TWIST AND DRAFTING DEVICE

[76] Inventor: Theodor Preussner, Ermlandstrasse 92E, D-3004 Isernhagen 2, Fed. Rep. of Germany

[21] Appl. No.: 557,137

[22] PCT Filed: Mar. 9, 1983

[86] PCT No.: PCT/EP83/00070

§ 371 Date: Oct. 20, 1983

§ 102(e) Date: Oct. 20, 1983

[87] PCT Pub. No.: WO83/03268

PCT Pub. Date: Sep. 29, 1983

[30] Foreign Application Priority Data

Mar. 13, 1982 [DE] Fed. Rep. of Germany ..... 3209169
Jul. 16, 1982 [DE] Fed. Rep. of Germany ..... 3226572

[51] Int. Cl.[4] ..... D07B 3/10

[52] U.S. Cl. ..... 57/58.57; 57/9; 57/58.52; 57/58.59; 57/58.65; 57/311

[58] Field of Search ..... 57/58.32, 58.34, 58.36, 57/58.38, 58.3, 58.52, 58.54, 58.61, 58.65–58.68, 70, 71, 68, 9, 311, 58.57, 58.59

[56] References Cited

U.S. PATENT DOCUMENTS

| | | | |
|---|---|---|---|
| 2,546,977 | 4/1951 | Clary, Jr. et al. | 57/58.57 X |
| 3,090,190 | 5/1963 | Boussu et al. | 57/311 X |
| 3,309,857 | 3/1967 | Haugwitz | 57/58.52 X |
| 3,388,541 | 6/1968 | Biagini | 57/311 X |
| 3,396,522 | 8/1968 | Biagini | 57/311 X |
| 3,413,793 | 12/1968 | Stine | 57/68 |
| 4,385,486 | 5/1983 | Iwata et al. | 57/58.59 X |
| 4,473,995 | 10/1984 | Gentry | 57/58.65 X |

FOREIGN PATENT DOCUMENTS

| | | |
|---|---|---|
| 286833 | 12/1970 | Austria . |
| 1263914 | 2/1972 | United Kingdom . |

*Primary Examiner*—John Petrakes
*Attorney, Agent, or Firm*—Michael J. Striker

[57] ABSTRACT

In such a device, with a rotor support frame and a drafting wheel mounted transversely of its axis of rotation, the effects of the gyroscopic and centrifugal forces on the rotor support frame should be avoided so far as possible. For this, an oppositely-driven rotary member (13) is mounted on the axis of rotation (12) of the drafting wheel (10). The shape, dimensions, masses and/or velocities of rotation of the drafting wheel (10) and the rotary member (13), as well as the parts (26,25,14,27,28; 34,33,15,35,36) rotating with them, are selected so that the product of the mass moment of inertia and the angular velocity of the counter-rotating components is at least approximately uniform in magnitude. The drafting wheel (10) and the rotary member (13) are each mounted upon the common axis of rotation (12) by means of a hollow shaft (28,36). The hollow shafts (28,36) are rotatably mounted and supported (31,32; 38,39) against the centrifugal forces at the axis of rotation (12) directed toward the rotor support frame (1). The product of the total mass of the components (25,26,14,27,28,31,32,12,24) associated with the drafting wheel (10) and the distance of their common center of mass from the longitudinal axis of the rotor support frame (1) is made at least approximately equal to the product of the total mass of the components (33,34,15,35,36,38,39,24,12) associated with the rotary member (13) and the distance of their common center of mass from the longitudinal axis of the rotor support frame (1).

24 Claims, 5 Drawing Figures

Figure 1:
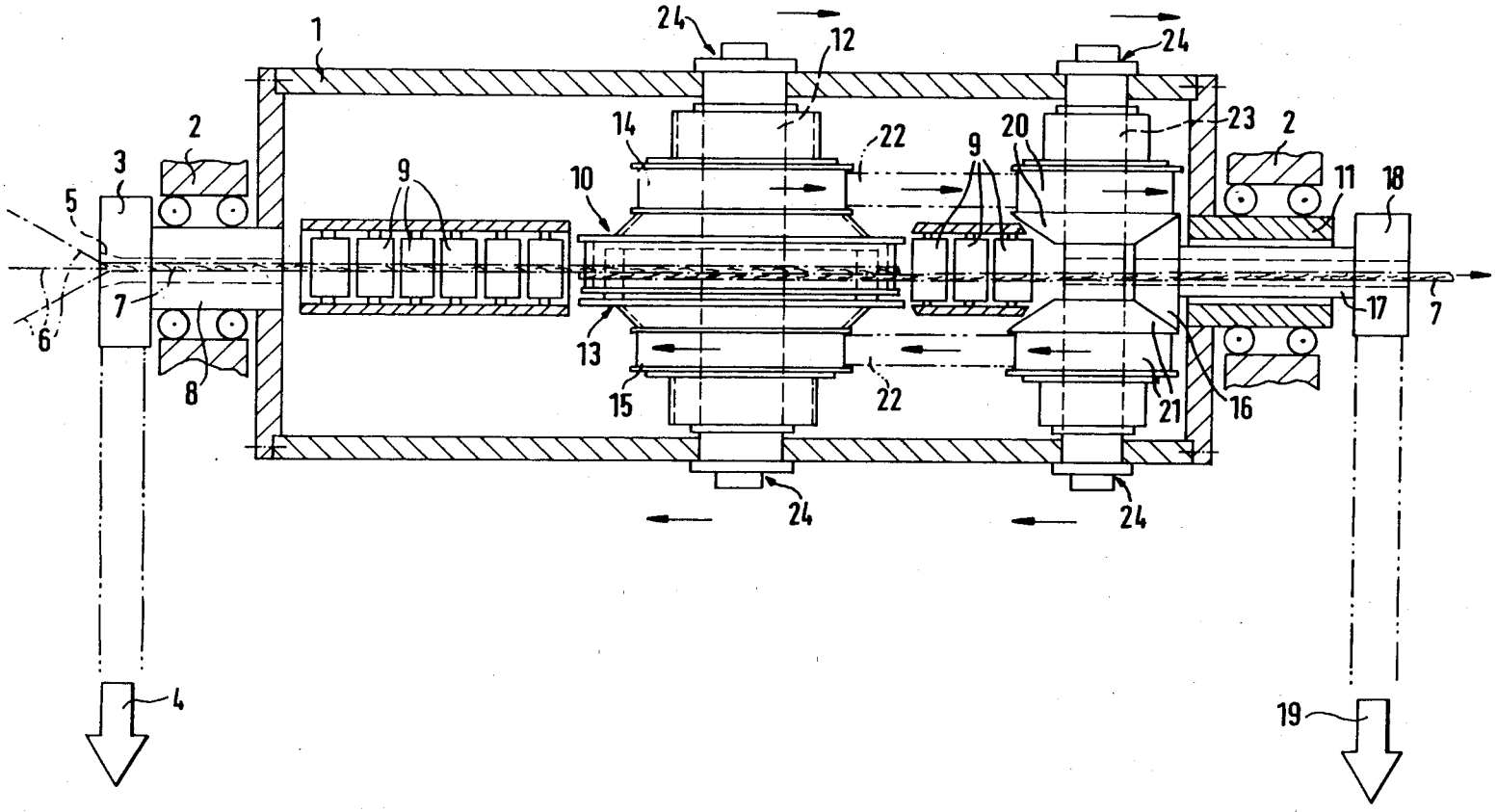

STRANDING DEVICE FOR STRANDING MACHINES, PARTICULARLY A PRE-TWIST AND DRAFTING DEVICE

The invention relates to a stranding device for stranding machines, particularly a pre-twist and drafting device as an advance ancillary device for single and multiple rope-lay machines, with a rotatably-driven rotor support frame and a driven drafting wheel mounted on the rotor support frame, transversely of the rotational and longitudinal axes thereof, in which the wire rope components are supplied to a stranding entry station in the longitudinal axis of the rotor support frame and the wire rope is guided at the rotor support frame to the drafting wheel and, after passing round it, is guided from the rotor support frame along the longitudinal axis.

Conventional single-lay machines give the advantage of the highest attainable stranding quality, although they are much too slow in comparison with current double-lay machines, however. The known double-lay machines are preferable to single-lay machines, however, substantially only as regards their production rate. The very common three-layer or multi-layer strands of 16 or more bright wires can be prepared in a single stage very much more carefully, uniformly and thinly and in particular with substantially smaller variation and in the external diameter than in a double-lay operation. The economical handling of single-lay operation avoids excessive stretching, which would lead to hardening of the wires and thus a loss of electrical conductivity. The substantially smaller strand diameter tolerances permit considerably smaller covering thicknesses, on insulation with plastics materials or rubber. Depending upon the construction of the strands-governed by the number of wires and the wire diameter-the increased cost of insulation material in double-lay operation, compared to single-lay operation, amounts in practical measured cases to from 19.5% up to a maximum of 27.8% (see "Drahwelt" 7—1977, p 271).

It is now known that the quality of stranding in double-lay machines is particularly increased if, before passing into the double-lay rotor frame, a pre-twist device is provided, which drives the strands directly with the desired velocity of two draftings per double-lay rotation.

If this pre-twist device is constructed at the same time as a drafting device, it allows the tensile force to serve to overcome the total resistance of all braking tensions in the single-lay bobbins. The strands further guided into the double-lay machine only for winding are thus considerably relieved from stresses.

A stranding device particularly suitable for the manufacture of multi-layer high-voltage cable as a pre-twist and drafting device must therefore (a) be able to produce strands which are uniform and thin as far as possible, in order to achieve significant savings in insulating material, (b) despite high-speed double-lay production speeds, effect pre-twisting so economically of material that any excess stretching and hardening of the stranded product is prevented and thus loss of electrical conductivity of the high-voltage cable, for instance, is avoided.

The main point is not a strand pre-twisted in a single-lay operation, without partial intermediate stranding by a double-lay machine, is led through to the coiling bobbin. What is important is that, in the single-lay pre-twist device, the entire cable (as a doubled single-lay) is withdrawn, so that, for the entire inner to outer wire layers, the correct wire lengths required for the doubled and prepared wire cable are drawn off. That only the strands produced on double-lay machines are basically not so uniform and so thin leads to the fact that, in the double-lay machine without a pre-twist device, at the entry to the machine, it is only for the first and thus still single rope strand that the appropriate wire lengths can be drawn off. The wire lengths being introduced, firstly suitable from layer to layer, i.e. correctly adjusted, no longer totally serve for the subsequent second-lay stage, since then the inner wire layers have relatively too large an excess length in comparison with the outer layers. The increasing relative excess length, from the outer to the inner layers in multi-layer cables, that is relative to the core wire, tends to form loops and thus leads to variation or increase in the cable diameter.

The method described could not be carried out up to the present therefore, since the velocity of the new double-lay machines subsequently developed was suddenly multiplied. No pre-twist and drafting devices operating in the single-lay mode have previously been known, which, as required, operated twice as fast as current double-lay machines.

To fulfil only the requirements stated under (a), so-called "pre-twist" devices are already in use, in industrial practice, (see "Drahtwelt", 7/1977, page 270, vol. 7 and page 271, 4th to 6th paragraphs of the chapter. "*Vergleich der Verfahren Einfach—und Doppelschlagverlitzungz*" ("*Comparison of the Method of Single-Lay and Double-Lay Stranding*") by A. C. Osman). These devices run rapidly, but they still only have simple traction wheels without any actual drafting action. The strands thus must be drawn from the outlet in the double-lay machine through to pre-twist device. The tension in the strands, after leaving the twist device, is not substantially reduced, but may even be substantially increased by the centrifugal force effect produced additionally in the device and not compensated by it. For pre-twisting in high-speed operation in a way economical of material, a driven drafting wheel which the strands pass round several times is essential. According to the known Euler looping law, the wire rope tension must be very rapidly reduced on the drafting wheel, so that the tensile force in the off-running cable run after the drafting wheel is substantially smaller than in the on-running cable run.

The drive of a drafting wheel, which for the purpose of guidance of the wire rope so as to be economical of material is mounted with its axis of rotation transversely to the rope-lay rotor axis, at high rope-lay rates of revolution, is a problem which has not previously been solved.

For high-speed double-lay production rates, the known pre-twist and drafting devices of the prior art (e.g. AT-PS 286833) are already known to be unsuitable, since the usual drive of the drafting wheel is effected over a toothed belt drive mounted wholly eccentrically to the axis of rotation of the machine. The complete toothed belt drive is thus arranged outside the lay-up rotor constructed as a frame support. For a current constructional size with a drafting wheel diameter of 180 mm, for example, corresponding frame support measurements and a coiling rotor rate of revolution of 4,000 or more revolutions per minute, such a mode of construction would lead to unacceptable centrifugal force loads on the rotor support frame. This would also give an entirely unacceptable short working life for the roller bearings involved.

For rapid operation, a further substantial difficulty now arises: a drafting wheel which is rotatably driven not only about its axis of rotation, but also at the same time about the axis of rotation of the rotor support frame perpendicular thereto, is a guided gyroscope, which is forced by its guide frame (the rotor support frame) to undergo precessional rotation. The precession thus imposed, as a result of the inertial forces, causes a strong gyroscopic effect, namely the gyroscopic couple.

The more rapid the rotation about the gyroscopic axis and also about the axis of precession and thus the greater the mass moment of inertia, the more significant are the gyroscopic forces with which the gyroscope resists alteration of the direction of its axis of rotation. Thus also the larger is the load on the rotor support frame, if it has to withstand these forces.

The difficulties mentioned with regard to the effect of the gyroscopic forces, as well as the centrifugal forces, in any use of stranding devices of the kind mentioned above, oppose the achievement of the desired high rotational velocities and thus rope-lay numbers.

The invention is based upon the purpose of providing a stranding device of the kind mentioned initially, which can be employed particularly as a pre-twist and drafting device as an advance ancillary device for single or multi-lay machines and particularly for double-lay machines and in which the desired particularly high velocities of rotation and thus rope-lay numbers can be achieved, without the aforementioned disadvantageous effects of gyroscopic and centrifugal forces attaining an unacceptable size. Thus, the rotor support frame, even at the highest possible velocities of rotation and rope-lay numbers, should be unaffected, as far as possible and at least substantially, by the effects of gyroscopic and centrifugal forces. A device which is as simple, compact and, particularly reliable as possible and has a long expected life, is thus desired. Above all, difficulties with the form and support of the drafting wheel should be taken into consideration, in this respect.

This is achieved in particular, in accordance with the invention, in that, a rotary member, driven in the opposite direction of rotation, is rotatably mounted on the axis of rotation of the drafting wheel and coaxially to it, and the shape, dimensions, masses and/or velocities of rotation of the drafting wheel and the rotary member, as well as the components rotating with them, are so selected that the product of the mass moment of inertia and the angular velocity of the counter-rotating components is at least approximately uniform in magnitude and that the drafting wheel and the rotary member are each mounted on their common axis of rotation by means of an associated hollow shaft and the hollow shafts are, in addition, rotatably mounted and supported on the common axis of rotation against centrifugal forces directed toward the rotor support frame and that the product of the total mass of the components associated with the drafting wheel and the distance of their common centre of mass from the longitudinal axis of the rotor support frame is made at least approximately equal to the product of the total mass of the components associated with the rotary member and the distance of their common centre of mass from the longitudinal axis of the rotor support frame.

By means of the inclusion, according to the invention, of a counter-rotating rotary member and correspondingly arranging the sizes of the counter-rotating components, the gyroscopic couple produced by the unit containing the drafting wheel, with the resultant gyroscopic force, is compensated by the gyroscopic couple produced by means of the oppositely-rotating unit containing the rotary member, so that the above-mentioned strong and undesirable gyroscopic forces cannot operate on the rotor support frame. By supporting the drafting wheel and the rotary member on the side toward the rotor support frame, according to the invention, a satisfactory force flux within both components along the axis of rotation is achieved, so that in conjunction with the size of the total masses and distances of their centres of gravity, according to the invention, (the sum of all static mass moments equals zero), even the aforementioned disadvantageous strong centrifugal forces can no longer have an effect on the rotor support frame. It is thus possible, without the aforementioned difficulties produced by the gyroscopic and centrifugal forces, to operate the stranding device at very high numbers of revolutions and, in particular, at the speeds desired for its use as a pre-twist and drafting device.

Rotor support frames and drafting wheels having extraordinarily high numbers of revolutions can thus be driven over long periods of time. It has been shown that, with a stranding device according to the invention, over 4,000 rope-lays per minute can be produced in continuous use, so that, with such a stranding device, the difficulties mentioned initially in the manufacture of strands and/or wire ropes can be overcome. The rotor support frame, in relation to the drafting wheel, serves merely for spatial fixing of the whole drafting unit, further loading of the rope-lay rotor, because of the compensation of the gyroscopic couples as well as the directed force flux for the centrifugal forces, either no longer occurring or only to a slight degree. The mutually-compensating shapes, dimensions, masses and velocities of rotation of the two contra-rotating units within the drafting system can be selected in accordance with the conditions of use and in accordance with the shape and layout of the rotor support frame, as well as the purpose of the stranding. The outer rotatable support of the hollow shafts is given in a simple way by combined radial and axial bearings. By the construction according to the invention, a simple and very compact overall arrangement is given, which is likewise advantageous for achieving the high velocities of rotation desired.

If the device according to the invention is used as a pre-twist and drafting device with an associated winding device for the wire rope, which comprises a rotating coaxially-arranged rotor member at which the wire rope from the pre-twist and drafting device is guided along the common axis of rotation, and a winding drum orbited by the rotor member, in the further development of the invention the rotary drive for the rotor support frame and the rotary drive for the drafting wheels of the pre-twist and drafting device, as well as the rotary drive for the rotor member of the winding device are derived in continuous connection by mechanical driving means, from a common main driving motor. This thus gives what may be called a close-coupled arrangement of the most important rotary drives and thus an exact control of the forces and tensions acting upon the wire rope, without expensive and troublesome regulating means on the wire rope itself in conjunction with separate drive arrangements or motors being required, so that altogether the stranding device so formed is constructed simply and reliably.

Figure 2:
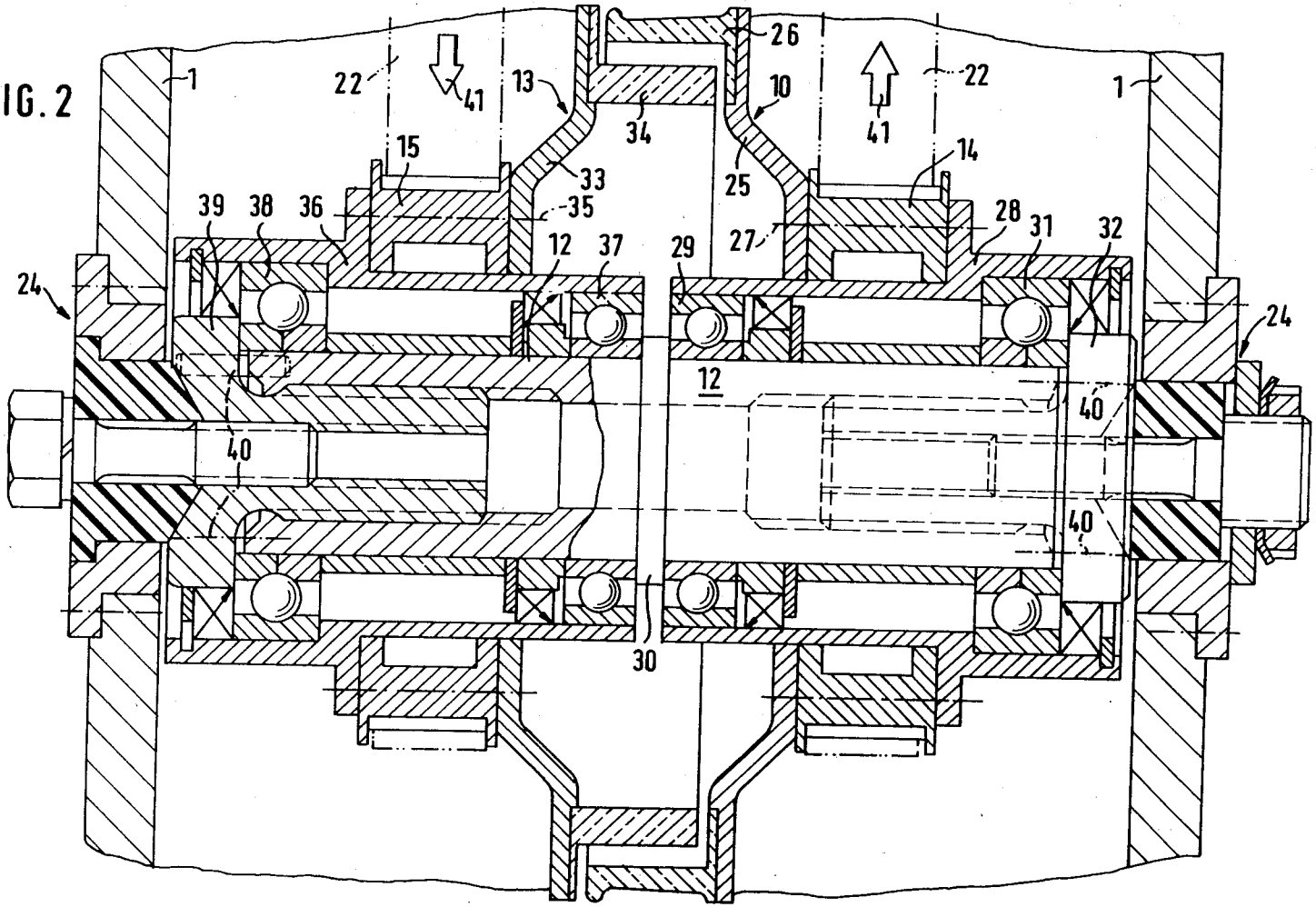
Figure 3:
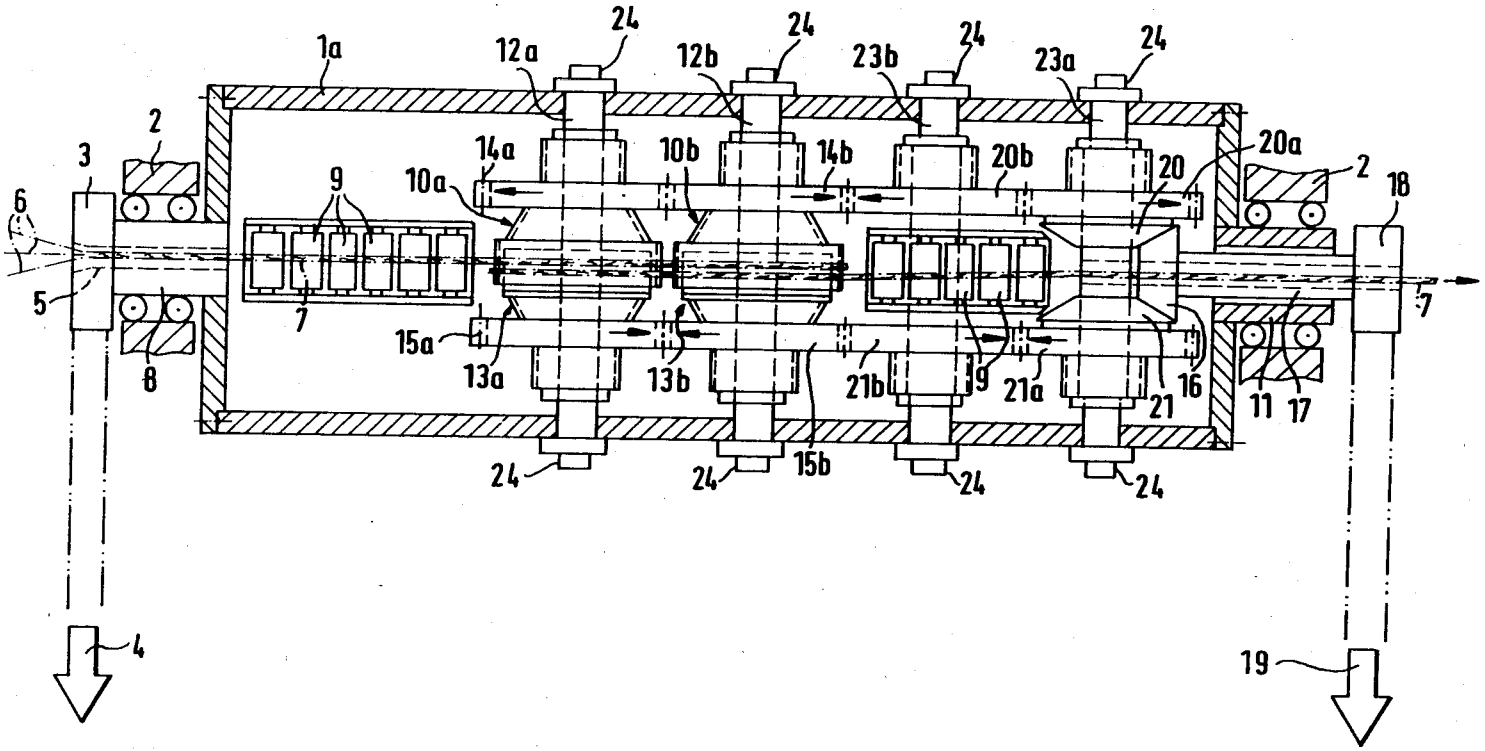
Figure 4:
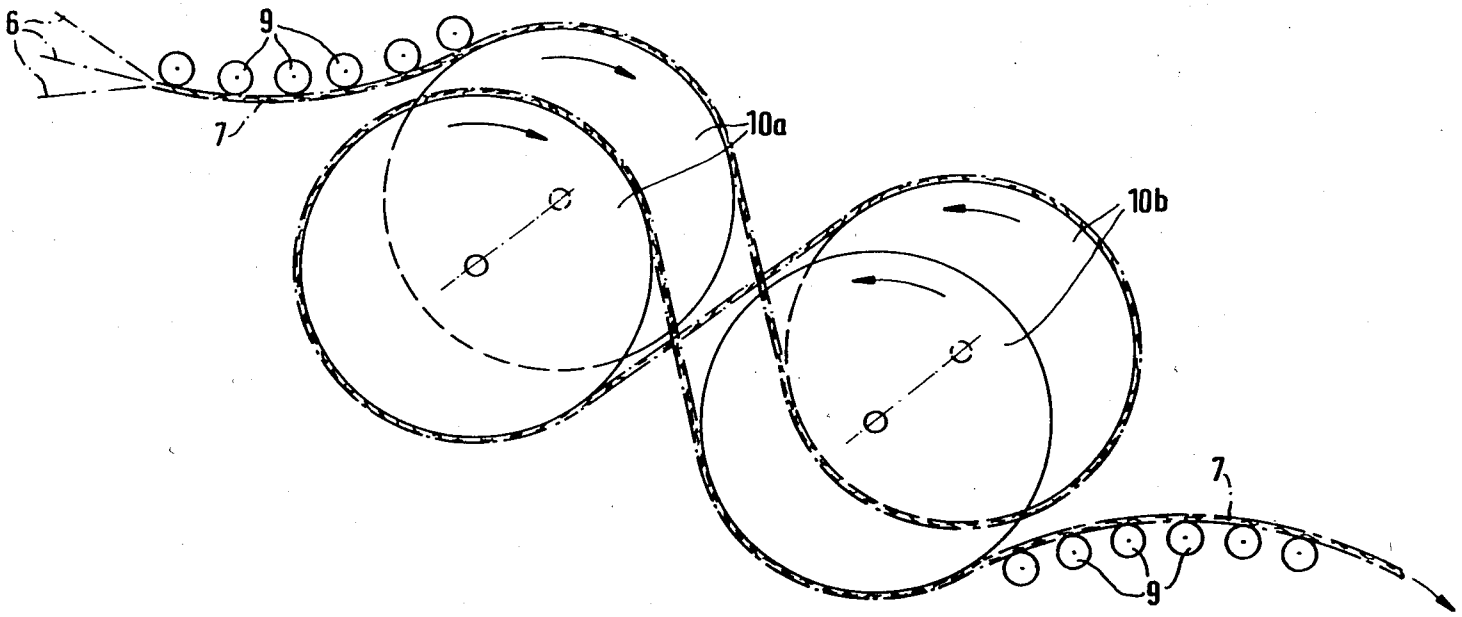
Figure 5:
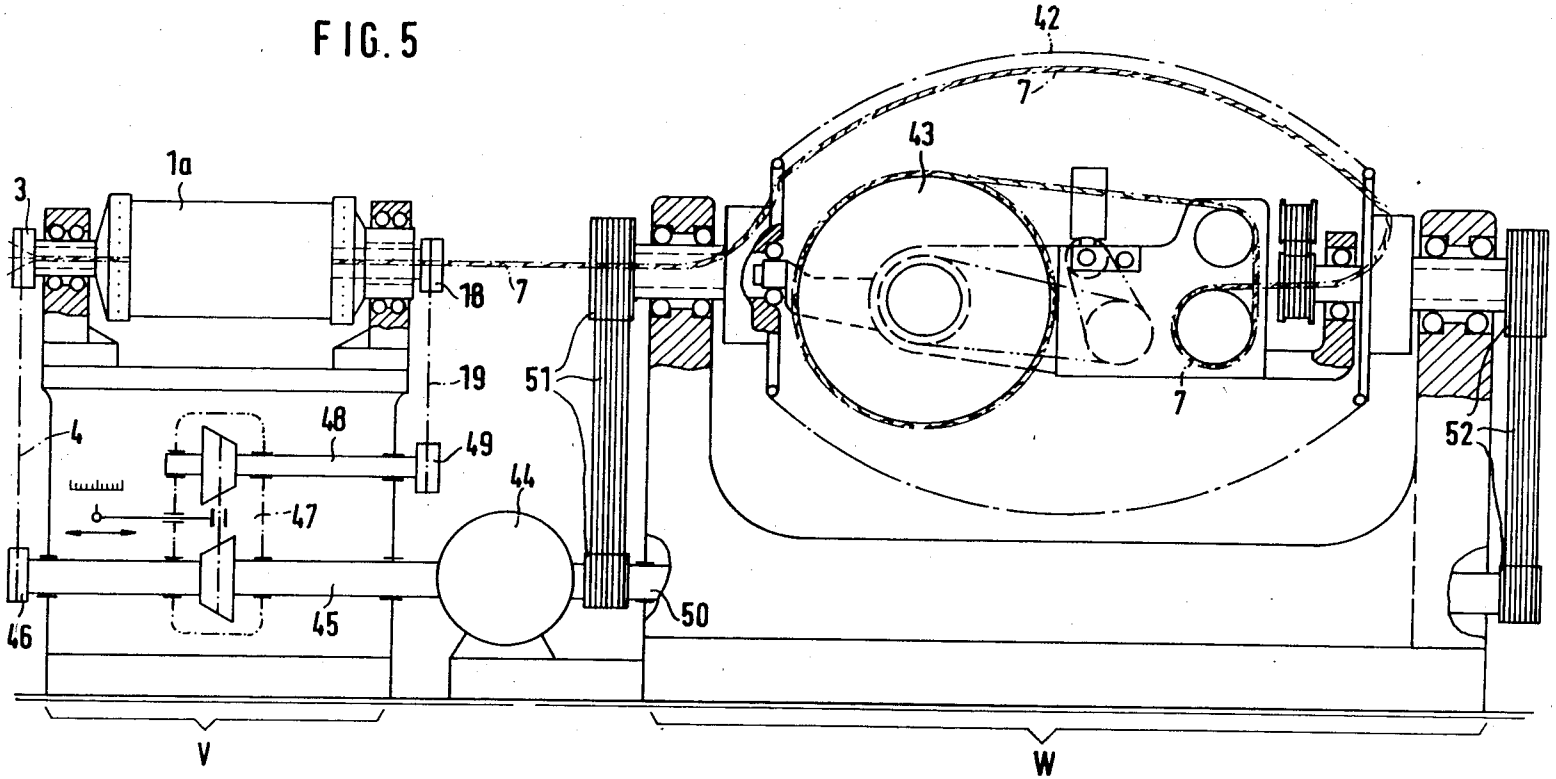

Further features, details and advantages of the invention will appear below in the claims and in the following description of embodiments of the stranding device, according to the invention, given in conjunction with the drawings. These show:

FIG. 1, a side view, shown diagrammatically as far as possible, of the stranding device according to the invention, with the rotor support frame in section;

FIG. 2, a longitudinal section through the drafting device of the stranding device according to FIG. 1, with its drafting wheel and counter-rotating rotary member;

FIG. 3, a side view, shown diagrammatically as far as possible, of the stranding device according to a further embodiment of the invention, with the rotor support frame in section and two drafting wheels with their drive mechanisms;

FIG. 4, a diagrammatic sketch arrangement of the wire rope guide on the winding surfaces of the drafting wheels in the embodiment according to FIG. 3; and FIG. 5, a purely diagrammatic side view of the entire stranding device with the pre-twist and drafting device, here shown as an example according to FIG. 3, and the winding device, wherein the pre-twist and drafting device is illustrated, by way of example, as a single-lay stranding device and the winding device as a double-lay winder.

In the following, the principal embodiment of the invention will first be described and explained in conjunction with FIGS. 1 and 2.

A rotationally-symmetrical, namely cylindrically constructed, rotor support frame 1 is mounted at both ends, for rotation about its longitudinal axis, in a suitable machine frame, which is indicated at 2. At one of its ends, the rotor support frame 1 is rotatably driven about its longitudinal axis by means of a driving wheel or a driving pulley 3, e.g. by means of a suitable belt drive, as indicated by the arrow 4. The driving pully 3 also forms the standing entry station 5 for the wire rope components 6, which are twisted to form the wire rope 7. The wire rope 7 is guided into this by the hollow supporting shaft 8 of the rotor support frame and is guided to the drafting wheel, which is indicated generally at 10, over a plurality of wire rope guide rollers 9 mounted internally on the rotor support frame. After wrapping round the drafting wheel, the wire rope is taken back to the longitudinal axis of the rotor support frame 1 over a further plurality of wire rope guide rollers 9, which are mounted on the inner wall of the rotor support frame 1, and is guided out through the hollow supporting shaft 11 in a way described further below. The end of the rotor support frame 1 directed toward the supporting shaft 11 is referred to in the following as the wire rope outlet end of the rotor support frame.

As described in detail below in conjunction with FIG. 2, the drafting wheel 10 with its associated components is rotatably mounted on a common spindle 12 so that the components rotating with it extend to one side of the rotor support frame, in FIG. 1 upwardly.

On the same common spindle 12, a rotationally driven rotary member, which is indicated in FIG. 1 generally at 13, is also mounted so as to rotate in the opposite sense to the direction of rotation of the drafting wheel 10. The components rotating with the rotary member 13 are arranged on the other side of the axis of rotation, in FIG. 1 downwardly.

A belt pulley 14 is connected to the drafting wheel 10 and a belt pulley 15 is connected to the rotary member 13.

For the counter-rotational driving of the drafting wheel 10 with 14 and the rotary member 13 with 15, planetary gearing arranged at the wire rope outlet end of the rotor support frame 1 is employed. The sun wheel 16 is mounted for rotation about the longitudinal axis of the rotor support frame 1 by means of a hollow shaft 17 located in the supporting shaft 11 of the rotor support frame 1 and is driven by means of a suitable driving wheel 18, e.g. by a belt drive indicated by the arrow 19. The wire rope 7 is guided out through the sun wheel 16 and its hollow shaft 17. The two planet wheels (bevel gears) 20 and 21 mesh with the sun wheel (bevel gear) 16 and, as indicated by the arrows shown, are thus rotatably driven in mutually opposite directions. The planet wheels 20 and 21 are constructed as belt pulleys and are drivingly connected by means of belts, particularly toothed belts 22, with the belt pulleys 14 and 15 of the drafting wheel 10 and the rotary member 13. The planet wheels 20 and 21 are rotatably mounted on a common spindle 23. The spindles 12 and 23 are non-rotatably secured in the rotor support frame wall by suitable mounting means, as diagrammatically indicated at 24.

In accordance with the invention, the shapes, dimensions, masses and/or velocities of rotation of the drafting wheel 10 and the rotary member 13, as well as the respective components rotating with them, are so selected that the product of the mass moment of inertia and the angular velocity of the counter-rotating components is at least approximately uniform in magnitude. Furthermore, the product of the total mass of the components associated with the drafting wheel 10 and the distance of their common centre of mass from the longitudinal axis of the rotor support frame 1 is at least approximately equal to the product of the total mass of the components associated with the rotary member 13 and the distance of their common centre of mass from the longitudinal axis of the rotor support frame 1, which means that the sum of the static mass moments equals zero. A corresponding dimensional rule holds for the planet wheels 20 and 21 with the components rotating in common with them, as counter-rotating structural units. In this embodiment, the planet wheels 20 and 21 and the belt pulleys 14 and 15 and thus the drafting wheel 10 and the rotary member 13 are driven at equal but opposite rates of revolution, where a suitable transmission ratio between the planet wheel 20 and the belt pulley 14 and between the planet wheel 21 and the belt pulley 15 can be selected.

FIG. 2 shows an embodiment the constructional arrangement of the part of the stranding device relating to the drafting device.

The planetary gearing, when set in operation, has an extremely symmetrical construction, because of its arrangement in accordance with the invention, and the contrary driving movements for the drafting wheel and the counter-rotating rotary member are produced via the planet wheels, without the interposition of further driving elements. The basic construction of the planetary gearing also leads to a symmetrical arrangement with respect to the rotor support frame. The gyroscopic couples of the planet wheels and the components rotating with them are compensated, the centrifugal forces are absorbed, because of the associated force-flux, by the common axis of rotation and, by means of corresponding selection of the sizes described in relation to the drafting unit, the total masses and the distances of their centers of gravity (the sum of all static mass moments equaling zero) are made of equal magnitude, so that also with this driving arrangement the rotor support frame is kept wholly or substantially free from the effects of the gyroscopic forces and the centrifugal forces.

The drafting wheel, indicated generally at 10, consists of a disc-shaped mounting flange 25 and a peripheral annular body 26 arranged on its outer periphery, which forms the winding surface or drafting ring for the wire rope wrapped around it. The mounting flange 25, together with the associated belt pulley 14, is rigidly connected with the flange of an associated hollow shaft 28 by a suitable screw connection 27. This hollow shaft 28 is rotatably mounted on the common spindle 12 constructed as a mounting shaft, namely in the middle by means of a radial bearing 29, which is located on a central collar 30 of the spindle 12, and, at the side adjacent the rotor support frame 1, by means of a combined radial and axial bearing 31. The bearing 31 is located against the large flanged head of a tie rod 32, which is screwed coaxially into the rotational and mounting spindle 12, as shown in FIG. 2. Thus the entire rotating assembly 25, 26; 14, 28 is supported in the axial direction against the tie rod 32.

The rotary member indicated generally at 13 likewise consists of a disc-shaped mounting flange 33 and a peripheral annular body 34 is arranged on its outer periphery, which, as FIG. 2 clearly shows, lodges inside the peripheral annular body 26 of the drafting wheel 10, so that the rotary member 13 and the drafting wheel 10 are nested together. By means of suitable connecting screws 35, the mounting flange 33 of the rotary member 13 and the associated belt pulley 15 are rigidly connected with a hollow shaft 36. The hollow shaft 36 is mounted on the common rotational and mounting spindle 12, at its end near the middle, by means of a radial bearing 37, the bearing 37 being located on the collar 30 of the rotational and mounting spindle 12. At the end facing the rotor support frame wall, the hollow shaft 36 is mounted on the common rotational and mounting spindle 12 upon a combined radial and axial bearing 38. The bearing 38 is located in the axial direction against the large flanged head of a tie rod 39, which as FIG. 2 clearly shows is screwed into the common rotational and mounting spindle 12 and, like the tie rod 32, is fixed against rotation, e.g. by a pin 40 or the like. Thus the counter-rotating components 33, 34; 15; 36 are rotatably supported by the tie rod 39 in the axial direction, on the common rotational and mounting spindle 12.

The common rotational and mounting spindle 12, as FIG. 2 clearly shows, is connected to the rotor support frame by means of the two tie rods 32 and 39 and by a suitably adjustable screw connection, which is indicated generally at 24. The arrows 41 indicate the contrary driving and thus rotational movements of the drafting wheel 10 with its associated components and the contra-rotating rotary member 13 with its rotating components.

The bearing arrangement on the hollow shaft, the combined radial and axial bearing and the tie rod, described in conjunction with FIG. 2 with regard to the drafting device are employed in a corresponding way in the bearing arrangement for the planet wheels 20 and 21 on their common spindle 23.

The drafting wheel and the rotary member thus run within one another as far as possible and can therefore be positioned closely together, which enhances the compensatory effect as regards centrifugal forces. By arranging the peripheral annular body on a disc-like mounting flange, particularly satisfactory shaping for the compensatory effects is achieved and the requisite masses are thus substantially minimized. In particular, the masses of the associated peripheral annular body forming the main mass of the counter-rotating rotary member is surrounded, to the fullest extent possible, by the peripheral annular body of the drafting wheel, which is necessary especially for compensation of centrifugal forces. The constructional materials, shape and cross-sectional forms of the peripheral annular bodies and also the mounting flanges can be optimally selected for the desired compensatory effect on the one hand and for the desired compact construction on the other hand. By the interesting of the counter-rotating components, also, shortening of the whole drafting device is achieved, which also leads to a reduction in the centrifugal forces which need to be compensated.

In the embodiment illustrated, the drafting wheel 10 with the components rotating with it and the counter-rotating rotary member 13 with components rotating with it are driven at opposite, but equal speeds of rotation. To achieve the compensation for gyroscopic couples described initially, by a corresponding choice of the shapes, the dimensions and the masses of the counter-rotating components, different velocities of rotation can be used. FIG. 2 shows particularly clearly that, in order to achieve the above-mentioned compensation effect, in particular, the shapes, the dimensions and the masses, referring thus to the material, of the peripheral annular body 34 of the rotary member 13 can be chosen in a particularly suitable way. The same also holds for the characteristic data relating to the peripheral annular body 26 of the drafting wheel 10, which forms the drafting ring or tool for the wire rope. FIG. 2 also makes it clear that, by a suitably "asymmetric" choice of the characteristic data, the desired compensatory effect can also be achieved. FIG. 2 likewise makes it clear that the whole drafting device, as regards its centrifugal forces, comprises an enclosed force flux through the common rotational and mounting spindle 12, so that all centrifugal forces arising are absorbed within this closed system and cannot affect the rotor support frame 1.

Further embodiments of the invention are described and explained in conjunction with FIGS. 3 to 5.

In FIGS. 3 to 5 and the following description, only those components of the stranding device are described which are necessry for explaining the construction of the invention. In general, the constructional arrangement, particularly relating to the drafting wheels with their rotary members, is as described in conjunction with FIGS. 1 and 2.

A rotationally-symmetrical, namely cylindrically-constructed, rotor support frame 1*a* is mounted at both ends for rotation about its longitudinal axis in a suitable machine frame, which is indicated at 2. At one of its ends, the rotor support frame 1*a* is rotated about its longitudinal axis by means of a driving wheel or a driving pulley 3, e.g. by a suitable belt drive, as indicated by the arrow 4. The driving pulley 3 also forms the stranding entry station 5 for the wire rope strands 6 which are twisted into the wire rope 7. The wire rope 7 is guided through the hollow supporting shaft 8 of the rotor support frame 1*a* into the latter and is guided by way of a plurality of wire rope guide rollers 9, mounted inside the rotor support frame, to the drafting wheels, which are indicated generally at 10*a* and 10*b*. The wire rope runs first on to the first drafting wheel 10*a* nearer to it and is then guided several times alternately round one or other of the two drafting wheels. As FIG. 4 shows, the wire rope 7 is continuously guided around the drafting wheels 10*a* and 10*b*, while changing its winding direction and changing from one to the other of the drafting wheels, so that a path in the shape of an 8 is given, as FIG. 4 shows diagrammatically. After passing round both drafting wheels 10*a* and 10*b*, the wire rope is guided by means of a further plurality of guide rollers 9, which are mounted on the inner wall of the rotor support frame 1*a*, so as to return to the longitudinal axis of the rotor support frame 1*a*, and it is then guided out, in a way further described below, through the hollow supporting shaft 11.

This provision of a second drafting wheel and the corresponding alternate guiding of the wire rope on the drafting wheels, in conjunction with the peripheral guide grooves on at least one of the winding surfaces, leads to a more exact control of the behavior of the wire rope on the drafting wheels and thus to a correct and smoother guidance of the wire rope on the drafting wheels, even at the highest possible numbers of revolutions, so that insufficient drafting or even breakage of the wire rope is avoided. Thus, the arrangement described comprising the second drafting wheel with its associated rotary member leads, in the same way as the corresponding elements and components of the first drafting wheel, also with this second drafting wheel and its rotary member to a complete compensation of the gyroscopic and centrifugal forces. It may be particularly noted that all features relating to the shapes, dimensions and arrangements which are described in the main patent (sic) with reference to the first drafting wheel and its rotary member are also applicable to the second drafting wheel and its rotary member.

The end of the rotor support frame 1*a* directed towards the supporting shaft 11 is referred to in the following as the wire rope outlet end of the rotor support frame.

As described already in conjunction with FIGS. 1 and 2, both the drafting wheel 10*a* and also the drafting wheel 10*b* with their associated components are rotatably mounted on respective common spindles 12*a* and 12*b*, so that the components rotating with them extend to one side of the rotor support frame 1*a*, in FIG. 3 upwardly.

On the same common spindles 12*a* and 12*b*, associated with each drafting wheel, a counter-rotating driven rotary member is rotatably mounted so as to rotate contrary to the direction of rotation of the associated drafting wheels 10*a* and 10*b*, which rotary members are indicated generally in FIG. 3 at 13*a* and 13*b*. The components rotating with the rotary members 13*a* and 13*b* are arranged on the other side of the spindles 12*a* and 12*b*, being directed downwardly in FIG. 3.

The two drafting wheels 10*a* and 10*b* are connected to a gearwheel 14*a* and 14*b*. Each rotary member 13*a* and 13*b* is likewise connected to a gearwheel 15*a* and 15*b* respectively.

For the contrary rotational drive of the drafting wheels 10*a* and 10*b* on the one hand, as well as the rotary members 13*a* and 13*b* on the other hand, with their associated gearwheels 14*a*, 14*b* and 15*a* and 15*b* respectively, planetary gearing arranged on the wire rope outlet end of the rotor support frame 1*a* is employed. Its sun wheel 16 is mounted for rotation about the longitudinal axis of the rotor support frame 1*a* by means of a hollow shaft 17 located in the hollow supporting shaft 11 of the rotor support frame 1*a* and is driven by means of a suitable driving pulley 18, e.g. a driving belt indicated by the arrow 19. By means of the sun wheel 16 and its hollow shaft 17, the wire rope 7 is guided outwardly. The sun wheel 16, constructed as a bevel gear, meshes with two planet wheels 20 and 21, also constructed as bevel gears, which thus are rotated mutually oppositely. The planet wheels 20 and 21 are connected with gearwheels 20*a* and 21*a* respectively. A transmission gearwheel 20*b* or 21*b*, respectively, is interposed between the gearwheels 20*a* and 21*a* of the planet wheels 20 and 21 and the gearwheels 14*b* and 15*b* of the second drafting wheels 10*b* connected to the driving system and the associated rotary member 13*b*. Thus, the gearwheels 20*a*, 20*b*, 14*b*, 14*a* associated with the drafting wheel, on the one hand, and the gearwheels 21*a*, 21*b*, 15*b* and 15*a* associated with the rotary members are driven in mutually opposite directions, as indicated by the arrows indicated on the gearwheels in FIG. 3. The planet wheels 20 and 21 with their gearwheels 20*a* and 21*a*, as well as the transmission gearwheels 20*b* and 21*b*, are mounted on a common spindle 23*a* or 23*b* respectively. The spindles 12*a*, 12*b*, 23*a* and 23*b* are non-rotatably secured in the rotor support frame wall by means of suitable securing means, as diagrammatically illustrated at 24.

As described in conjunction with FIGS. 1 and 2, the shapes, the dimensions, the masses and/or the velocities of rotation of the drafting wheels 10*a* and 10*b*, as well as of the rotary members 13*a* and 13*b* and also the components rotating with them, are so selected that the product of the mass moment of inertia and the angular velocity of the counter-rotating units is at least approximately uniform. Furthermore, the product of the total mass of the components associated with the drafting wheels 10*a* and 10*b* and the distance of their common centre of mass from the longitudinal axis of the rotor support frame 1*a* is at least approximately equal to the product of the total mass of the rotary member 13*a* and the rotary member 13*b* respectively and the components associated therewith and the distance of their common centre of mass from the longitudinal axis of the rotor support frame 1*a*, which means that the sum of the static mass moments equals zero. A corresponding dimensional rule holds for the planet wheels 20 and 21 with their gearwheels 20*a* and 21*a* and the components rotating with them as counter-rotating components. Likewise, the corresponding dimensional rule holds for the transmission gearwheels 20*b* and 21*b* with the components rotating with them. In the embodiment illustrated, the planet wheels 20 and 21 with their gearwheels 20*a* and 21*a*, the transmission gearwheels 20*b* and 21*b*, the drafting wheels 14*b* and 14*a* as well as the rotary members 13*b* and 13*a* are driven at equal but contrary rates of rotation. Suitable step-up or step-down gear arrangements can be selected while maintaining the dimensional rules according to the invention, depending upon the particular type of use. It is important that the dimensional rules described in more detail above are adhered to.

If the transmission gearwheels are used for driving the various rotating components, in accordance with the invention, in the way characterized above, a relatively short constructional arrangement of the drive and drafting wheels with their associated rotary members is given. In this way, the gyroscopic couples of the transmission gearwheels and the components rotating with them are compensated and the centrifugal forces produced, as with the bearing and support of the planet wheels and the components rotating with them, are likewise absorbed in the overall force flux by the common axis of rotation and, by the selected sizing described of the total masses and their mass center distances (wherein the sum of all static masses equals zero) are dimensioned to be equal in magnitude, so that, with these transmission gearwheels and their arrangement and support also, the rotary support frame is shielded from the effects of the gyroscopic forces and the centrifugal forces totally or substantially. In this arrangement using transmission gearwheels, the achievement of the desired extremely high rates of revolution is also facilitated. At the same time, the gearwheels in connection with one another provide the desired contrary directions of rotation and, between the actual driving system with the planet wheels and the drafting wheel facing it, with its rotary member, a substantially greater distance is provided, which can be used for wire rope guidance is provided, which can be used for wire rope guidance with relatively large radii of curvature, in order to achieve the desired improved wire rope guidance. In this arrangement, moreover, the wire rope is guided continuously so as to pass round and from one to the other of the drafting wheels, while changing its direction of winding. Guidance off the wire rope around the drafting wheels in the shape of an 8 is thus given.

The winding surface of at least one of the drafting wheels 10*a* and 10*b* is provided with peripheral guide grooves, for guiding the wire rope, which are not shown in detail in order to simplify the diagrammatic representation. These are known concentric and adjacently-arranged peripheral grooves on the winding surface of the drafting wheel, which are suited to the particular conditions of use. A particularly exact guidance of the wire rope on the winding surfaces of the drafting wheels can be achieved by providing the winding surfaces of the two drafting wheels 10*a* and 10*b* with such peripheral guide grooves. It is desirable for the peripheral guide grooves on the drafting wheels 10*a* and 10*b* to be mutually displaced in the axial direction, preferably by half the groove width, in order to achieve a particularly satisfactory guidance of the wire rope in this way. Also, however, the spindle 12*b* of the second drafting wheel 10*a* can be set at a prescribed small angle with respect to the spindle 12*a* of the first drafting wheel 10*a*. Naturally, the gear ratios of the gearwheels 14*a*, 14*b* and 20*b*, as well as of 15*a*, 15*b* and 21*b*, are arranged correspondingly.

FIG. 5 shows wholly diagrammatically a further arrangement according to the invention. Firstly, FIG. 5 shows diagrammatically at V the pre-twist and drafting device with the rotor support frame 1*a* described in conjunction with FIG. 3. This pre-twist and drafting device V is located upstream of a winding device W. This winding device is constructed in known manner as a so-called double-lay winder. The wire rope 7 leaving the device V is guided coaxially to the winding device W. This includes a coaxially-arranged rotating rotor 42, as well as a winding drum 43 mounted in a freely suspended way therein, together with the associated wire rope guiding and laying devices, which are not shown in detail and are constructed in known manner. The wire rope 7 is guided in known manner to the rotor 42, along the longitudinal axis of the winding device W via the wire rope guiding and laying devices of the winding drum 43 (not shown). Thus, the pre-twist and drafting device V, in the form of a so-called single-lay stranding machine, is associated with a double-lay winder. The respective velocities of rotation are mutually adjusted in the prescribed way with this general arrangement.

This thus gives what may be called a close-coupled arrangement of the most important rotary drives and thus an exact control of the forces and tensions acting upon the wire rope, without expensive and troublesome regulating means on the wire rope itself in conjunction with separate drive arrangements or motors being required, so that altogether the stranding device so formed is constructed simply and reliably.

According to the invention, the rotary drive for the rotor support frame 1*a* and the rotary drive for the drafting wheel within the rotor support frame 1*a*, namely for the planetary gearing with its driving pulley 18 in the pre-twist and drafting device V, as well as the rotary drive for the rotor 42 of the winding device W, are derived by mechanical operation in a continuously connected manner from a common main driving motor, which is indicated at 44. Thus, via a shaft 45, the main driving motor 44 drives a belt pulley 46, which, via the belt 4, operates the driving pulley 3 for the rotor support frame 1*a*. Via an adjustable gear mechanism 47, furthermore, by way of the driving shaft 48 and the belt pulley 49, as well as the driving belt 19 and the driving pulley 18, the planetary gearing for operating the drafting wheels of the rotor support frame 1*a* are coupled to the shaft 45 of the main driving motor 44. As the adjustable gear mechanism 47, a differential gear with a suitable motor can be provided. Finally, via a further shaft 50 from the main driving motor 44 and a suitable belt drive, indicated generally at 51, the rotor 42 is likewise coupled with the main driving motor 44. Furthermore, from the shaft 50 of the main driving motor 44 via the belt drive 52, the drive for the rotor 42 and for the winding drum 43 with its wire rope guiding and laying devices are driven, as shown diagrammatically in FIG. 5.

The arrangement described above can likewise be constructed with the stranding device according to FIGS. 1 and 2 as the pre-twist and drafting device V.

I claim:

1. A stranding device for stranding machines, particularly a pre-twist and drafting device as an advance ancillary device for single or multiple rope-lay machines, the stranding device comprising a driven rotor support frame rotatable about a longitudinal axis of rotation and having a stranding entry station; a driven drafting wheel mounted on said rotor support frame and rotatable about a transverse axis which is transverse to said longitudinal axis of said driven rotor support frame, so that a wire rope component is supplied at said stranding entry station substantially along said longitudinal axis of said rotor support frame, is guided at said rotor support frame to said drafting wheel, passes around said drafting wheel, and then is guided along said longitudinal axis from said rotor support frame; a rotary member rotatable in a direction which is opposite to the direction of rotation of said drafting wheel about said transverse axis coaxially with said drafting wheel; components rotatable with said drafting wheel; components rotatable with said rotary member, the shape, dimensions, masses and/or velocities of rotation of said drafting wheel and said rotary member, as well as said components rotating with them, being selected so that a product of the mass moment of inertia and an angular velocity of said drafting wheel with its components and said rotary member with its components rotating in opposite directions are at least approximately uniform in magnitude; a common axle defining said transverse axis of rotation of said drafting wheel and said rotary member, said drafting wheel and said rotary member having each an associated hollow shaft and said hollow shafts being rotatably mounted and supported on said common axle against centrifugal forces directed toward said rotor support frame, and a product of the total mass of said components rotating together with said drafting wheel and a distance of their common centre of mass from said longitudinal axis of said rotor support frame being at least approximately equal to the product of the total mass of said components rotating together with said rotary member and the distance of their common centre of mass from said longitudinal axis of said rotor support frame.

2. A stranding device as defined in claim 1, wherein said rotor support frame has a wire rope outlet end; and further comprising means for rotatably driving said drafting wheel and rotary member about said transverse axis and including a belt drive with belt pulleys each arranged for a respective one of said drafting wheel and said rotary member at their side facing toward said rotor support frame, and a planetary gearing arranged at said wire rope outlet end of said rotor support frame and having a sun wheel mounted for rotation about said longitudinal axis of said rotor support frame and provided with a hollow driving shaft for receiving the wire rope at said wire rope outlet end, and counter-rotating planet wheels formed as belt pulleys and rotatable about a common axis of rotation which is parallel to said transverse axis of rotation of said drafting wheel and said rotary member, and counter-rotating components rotating together with said planet wheels, said planet wheels with said components rotating with them being arranged in shape, dimensions, masses and/or velocities of rotation so that a product of the mass moment of inertia and an angular velocity of said counter-rotating components are at least approximately uniform in magnitude, said common axis of rotation of said counter-rotating planet wheels being defined by an axle, and said counter-rotating components being rotatably mounted and supported on said common axle which defines said axis of rotation of said counter-rotating planet wheels, against centrifugal forces directed toward said rotor support frame.

3. A stranding device as defined in claim 2, wherein said belt drive of said means for rotatably driving said drafting wheel and said rotary member is formed as a toothed belt drive.

4. A stranding device as defined in claim 2; and further comprising a common mounting shaft defining said transverse axis of rotation, said drafting wheel and said rotary member and their associated belt pulleys being secured on said hollow shafts respectively, said rotor support frame having a plurality of walls; tie rods each inserted coaxially into said common mounting shaft and connected with a respective one of said rotor support frame walls which is adjacent to said tie rod; and bearings arranged on said tie rods and each rotatably supporting a respective one of said hollow shafts of said drafting wheel and said rotary member.

5. A stranding device as defined in claim 4, wherein said tie rods are screwed into said common mounting shaft.

6. A stranding device as defined in claim 4, wherein said bearings are formed as combined radial and axial bearings.

7. A stranding device as defined in claim 4, wherein said hollow shafts have ends adjacent to said longitudinal axis of said rotor support frame, said mounting shaft having a central collar, and said hollow shaft being supported at said ends adjacent to said longitudinal axis by means of said bearings at said central collar of said mounting shaft.

8. A stranding device as defined in claim 7, wherein said bearings are formed as radial bearings.

9. A stranding device as defined in claim 7, wherein said bearings are formed as combined radial and axial bearings.

10. A stranding device as defined in claim 4, wherein tie rods are secured in said rotor support frame walls; and further comprising means for securing said tie rods in said rotor support frame walls and including an adjustable screw connection.

11. A stranding device as defined in claim 1, wherein said drafting wheel and said rotary member each include a disk-shaped mounting flange and a laterally projecting peripheral annular body arranged so that said peripheral annular body of one of said drafting wheel and rotary member is directed toward said mounting flange of other of said drafting wheel and rotary member, said peripheral annular body of said drafting wheel forming a winding surface for the wire rope, and said peripheral annular body of said rotary member being located within said peripheral annular body of said drafting wheel.

12. A stranding device as defined in claim 1; and further comprising means for guiding the wire rope in said rotor support frame and including a plurality of wire rope guide rollers arranged in the interior of said rotor support frame.

13. A stranding device as defined in claim 1, wherein said rotor support frame is formed as a rotationally-symmetrical body.

14. A stranding device as defined in claim 1, wherein said rotor support frame is formed as a cylindrical, drum-shaped hollow body.

15. A stranding device as defined in claim 1; and further comprising a second such drafting wheel and a second such rotary member driven in opposite directions of rotations about a further transverse axis extending transversely to said longitudinal axis of said rotor support frame, said second drafting wheel and said second rotary member having components rotatable therewith, and said second drafting member and second rotary member with said components rotating therewith being shaped, dimensioned and arranged in the same way as said first mentioned drafting wheel with said first mentioned rotary member and their rotating components, and so that the wire rope is guided to pass continuously around and from one to the other of said drafting wheels.

16. A stranding device as defined in claim 15, wherein at least one of said drafting wheels is provided with peripheral guide grooves for guiding the wire rope.

17. A stranding device as defined in claim 15; and further comprising means for driving said drafting wheels and said rotary members and including a planetary gearing with gear wheels each connected with respective one of said drafting wheels and said rotary members, and planet wheels provided with further gear wheels arranged to transmit rotation of said planet wheels to said gear wheels of said drafting wheels and said rotary members.

18. A stranding device as defined in claim 17, wherein said driving means further includes counter-rotating transmission gear wheels arranged between said further wheels of said planet wheels and said gear wheels connected with said second drafting wheel and said second rotary member, said planet wheels with said further gear wheels being mounted for rotation about a common axis of rotation, said transmission gear wheels being also mounted for rotation about a further common axis of rotation which is parallel to said common axis of rotation of said planet wheels with said further gear wheels, said transmission gear wheels and said planet wheels and said further gear wheels having rotating parts and being arranged with their rotating parts in shapes, dimensions, masses and/or velocities of rotation so that a product of the mass moment of inertia and an angular velocity of their counter-rotating components are at least approximately uniform in magnitude, said transmission gear wheels having an axis of rotation defined by a common axle and said transmission gears being rotatably mounted and supported on said common axle against centrifugal forces directed toward said rotor support frame, the wire rope being guided continuously so as to pass around and from one to the other of said drafting wheels while changing its direction of winding.

19. A stranding device as defined in claim 15, wherein said drafting wheels have peripheral guide grooves which are mutually displaced in an axial direction of said drafting wheels.

20. A stranding device as defined in claim 19, wherein said grooves have a predetermined width, said peripheral guide grooves of said drafting wheels being displaced in said axial direction relative to one another by half of said groove width.

21. A stranding device as defined in claim 15, wherein said second drafting wheel is arranged so that said further transverse axis of rotation is inclined at a substantially small angle relative to said first-mentioned transverse axis of rotation of said first mentioned drafting wheel.

22. A stranding machine, comprising a stranding device formed as a pre-twist and drafting device and including a driven rotor support frame rotatable about a longitudinal axis of rotation and having a stranding entry station, a drafting wheel mounted on said rotor support frame and rotatable about a transverse axis which is transverse to said longitudinal axis of said driven rotor support frame, so that a wire rope component is supplied at said stranding entry station substantially along said longitudinal axis of said rotor support frame, is guided at said rotor support frame to said drafting wheel, passes around said drafting wheel, and then is guided along said longitudinal axis from said rotor support frame, a rotary member rotatable in a direction which is opposite to the direction of rotation of said drafting wheel about said transverse axis coaxially with said drafting wheel, components rotatable with said driven drafting wheel, components rotatable with said rotary member, the shape, dimensions, masses and/or velocities of rotation of said drafting wheel and said rotary member, as well as said components rotating with them, being selected so that a product of the mass moment of inertia and an angular velocity of said drafting wheel with its components and said rotary member with its components rotating in opposite directions are at least approximately uniform in magnitude, a common axle defining said transverse axis of rotation of said drafting wheel and said rotary member, said drafting wheel and said rotary member having each an associated hollow shaft and said hollow shafts being rotatably mounted and supported on said common axle against centrifugal forces directed toward said rotor support frame, and a product of the total mass of said components rotating together with said drafting wheel and a distance of their common centre of mass from said longitudinal axis of said rotor support frame being at least approximately equal to the product of the total mass of said components rotating together with said rotary member and the distance of their common centre of mass from said longitudinal axis of said rotor support frame; a winding device for the wire rope including a rotor member rotating coaxial with said rotor support frame about said longitudinal axis and arranged so that the wire rope from said rotor support frame of said stranding device is guided at said rotor member along said longitudinal axis, and a winding drum orbited by said rotor member; a first rotary drive for said rotor support frame of said stranding device; a second rotary drive for said drafting wheel of said stranding device; a third rotary drive for said rotor member of said winding device; and a common main driving motor with mechanical driving means connecting continuously said common main driving motor with said first, second and third rotary drives.

23. A stranding machine as defined in claim 22; and further comprising a variable gear unit provided between said main driving motor and said second rotary drive for said drafting wheel.

24. A standing device as defined in claim 22, wherein said rotor support frame has a wire rope outlet end; and further comprising means for rotatably driving said drafting wheel and rotary member about said transverse axis and including a drive for said drafting wheel and said rotary member, and a planetary gearing arranged at said wire rope outlet end of said rotor support frame and having a sun wheel mounted for rotation about said longitudinal axis of said rotor support frame and provided with a hollow driving shaft for receiving the wire rope at said wire rope outlet end, and counter-rotating planet wheels rotatable about a common axis of rotation which is parallel to said transverse axis of rotation of said drafting wheel and said rotary member, and counter-rotating components rotating together with said planet wheels, said planet wheels with said components rotating with them being arranged in shapes, dimensions, masses and/or velocities of rotation so that a product of the mass moment of inertia and an angular velocity of said counterrotating components are at least approximately uniform in magnitude, said common axis of rotation of said counter-rotating plane wheels being defined by an axle, and said counter-rotating components being rotatably mounted and supported on said common axle which defines said axis of rotation of said counter-rotating planet wheels, against centrifugal forces directed toward said rotor support frame.

* * * * *